United States Patent [19]

Arnsteiner

[11] Patent Number: 4,523,772

[45] Date of Patent: Jun. 18, 1985

[54] SANDWICH TYPE CONSTRUCTION MULTILAYER SKIS

[75] Inventor: Anton Arnsteiner, Mittersill, Austria

[73] Assignee: Blizzard Gesellschaft m.b.H., Mittersill, Austria

[21] Appl. No.: 495,797

[22] Filed: May 18, 1983

[30] Foreign Application Priority Data

May 26, 1982 [AT] Austria ..... 2080-82

[51] Int. Cl.[3] ..... A63C 5/00

[52] U.S. Cl. ..... 280/610; 428/47; 428/48

[58] Field of Search ..... 428/47, 48; 280/601, 280/602, 606, 609, 608, 610

[56] References Cited

U.S. PATENT DOCUMENTS

| | | | |
|---|---|---|---|
| 3,381,972 | 5/1968 | Miller | 280/608 |
| 3,790,184 | 2/1974 | Bandrowski | 280/610 |
| 3,801,116 | 4/1974 | Benner | 280/610 |
| 3,844,576 | 10/1974 | Schultes | 280/610 |
| 4,300,786 | 11/1981 | Alley | 280/602 |

FOREIGN PATENT DOCUMENTS

| | | | |
|---|---|---|---|
| 2558930 | 7/1977 | Fed. Rep. of Germany | 280/609 |
| 2627887 | 12/1977 | Fed. Rep. of Germany | 280/609 |

*Primary Examiner*—George F. Lesmes
*Assistant Examiner*—Nancy A. B. Swisher
*Attorney, Agent, or Firm*—Toren, McGeady, Stanger

[57] ABSTRACT

A multilayer ski with a sandwich type construction includes a core, a cover layer on one side of the core, a running base layer on the other side of the core and at least one web positioned between the core and one of the cover layer and the running layer. One of the web or the core is divided across the width of the ski into a plurality of parts with each part having a different shear modulus. Longitudinally extending parts of the ski on opposite sides of an imaginary plane extending perpendicularly to the running base layer in the long direction of the ski and positioned at least close to the central longitudinal axis of the ski, have different torsional strengths.

9 Claims, 7 Drawing Figures

SANDWICH TYPE CONSTRUCTION MULTILAYER SKIS

SUMMARY OF THE INVENTION

The present invention is directed to a sandwich construction multilayer ski with a core positioned between a cover layer and a running base layer and with at least one web provided between the core and the cover layer or the running layer, and with edge strips possibly arranged along one or both of the upper and lower surfaces.

Due to their manner of construction, which is symmetrical relative to the longitudinal central axis of the ski, the known alpine ski constructions have the same turning resistance in both turning directions with reference to the long axis of the ski so that the edge pressure distributions, according to the respective direction of the edge, running on its edge, has a necked down arrangement symmetrical relative to the central axis of the ski.

In a known alpine ski in which the laterally defining edges include steel edges and which steel edges define the running base and extend assymmetrically relative to the long axis extending through the tip of the ski and the center of the end of the ski, whereby due to the edge arrangement—inward/outward or left/right, respectively—a different control behavior of the skis results.

Other skis are known where the ski tip is arranged offset assymmetrically relative to the inside of the foot whereby a threading in in the slalom gates of a slalom course are to be avoided.

For reasons of equilibrium, the inner edge of the ski located on the outside of a curve when traversing a downhill course, is chiefly used while the outer edge of the same ski is not used or, if so, only to a slight degree. The other ski in such a traversing course, remains more or less unloaded. For this reason, the inner edge is constructed so as to be sharper, in order to increase the edge grip on hard slopes, while the outer edge is rounded.

It is also known that the edge grip is stronger, in a predetermined geometry and ski rigidity distribution, with a higher turning resistance at the long axis of the ski.

A ski is disclosed in German Offenlegungsschrift No. 20 24 622 in which reinforcing elements increase the turning resistance at the two ends of the ski. Either strips or plates of a material, more resistant to turning than the material of the main ski body, serve as reinforcing elements. With reference to the long axis of the ski, these reinforcing elements, arranged in the blade area and in the end area of the ski, extend symmetrically so that each cross-sectional plane of the ski has a symmetrical construction. Due to this symmetrical construction, the characteristics of the ski, with reference to its longitudinal center plane, are also the same for both halves of the ski. Thus, the behavior of the ski with reference to its longitudinal central axis is symmetrical in each cross-sectional plane.

East German Pat. No. 38 383 discloses a ski whose maneuverability and stability is improved compared to previously known constructions. The skis are constructed in a manner so that they are not exchangeable and are fashioned so that the inner edge, specifically of each ski inclined downwardly, is constructed differently and is arranged, in relation to the ski binding with respect to the uphill edge, so that it has a better engagement with the snow than the outer edge. Further, the ski edges on both edges of the ski are provided with different strengths relative to the running base; or at least one ski edge is divided in the long direction wherein the edge strips, as produced, are offset relative to one another in a stepwise manner; or else the upper ski supporting surface, at least in the area of the binding, is inclined relative to the running base of the ski, that is, the support plane for the binding extends diagonally relative to the running base of the ski. Since one ski is not only diagonally oriented relative to the slope, but also downwardly along the line of the slope, such a known construction is not advisable, and, in addition, it is scarcely possible to manufacture such skis when they have a sandwich type construction. This known ski construction is practical only in completely wooden skis at an expense which is no longer feasible for modern mass production. In this last mentioned construction of the known ski, the skier stands diagonally relative to the ski surface.

Therefore, as a point of departure of the present invention from the known ski constructions, in skiing, the inner edge of the running base has a different function than the outer edge and it is intended to construct the ski in such a way, when the long ski axis is seen as the turning axis, it has different turning resistances according to the turning direction. Moreover, the ski can be produced in a sandwich type construction achieved, in accordance with the present invention, with at least one web and/or core construction in several parts with reference to the width of the ski and the individual parts of the web or core, respectively, have different shear moduli and the web or the core may have various thicknesses across the width of the ski. Further, the individual parts of the web or of the core are arranged across the width of the ski so that the shear moduli of the different parts increase or decrease across the width of the ski so that the two longitudinal parts of the ski located on the opposite sides of an imaginary division plane disposed perpendicularly to the running base and extending in the long direction of the ski at or close to the central long axis of the ski have different torsional strengths. The construction is arranged so that the turning resistance is more rigid in the direction of the inner edge of the ski than in the direction of the outer edge. As a result, edge pressure distributions are achieved on the inner edges which are increased relative to the pressures on the outer edge in an edge-up ski in the front and rear parts of the ski.

The advantage of this construction is that the edge grip of the downhill ski is greatly increased through the increased torsional stability on the inner edge of the downhill ski.

If the outer edge of the uphill ski, which is under less load, is loaded due to a travel error, then there is less tendency for the outer edge of the uphill ski to make a false cut and the danger of falling is reduced as a consequence of the lesser torsional stability of the construction.

Another possibility for the advantageous use of the construction embodying the present invention consists in adapting the various torsion resistancies to different applications.

Therefore, it would be possible to achieve extremely easy turning ability by selecting the torsionally weaker edge side as the inner edge in soft slope conditions, conditions where the edge grip and danger of faulty cutting are considered to be secondary, whereas, on a hard slope, the edge grip can be increased and the tendency to faulty cutting can be reduced by selecting the torsionally harder edge side as the inner edge.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
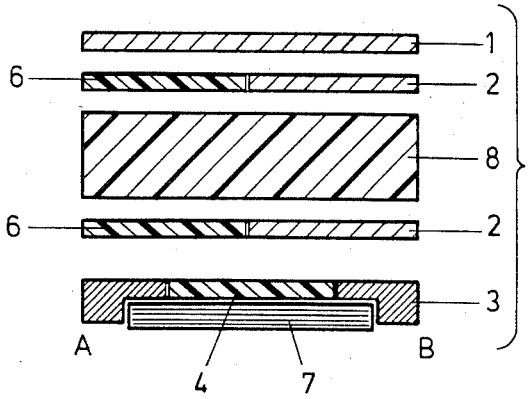
FIGS. 1, 2, 3, 5, and 6 illustrate exploded cross-sectional views of different embodiments of a ski incorporating the present invention.

In FIG. 1 an exploded cross-sectional view is shown of a sandwich construction multilayered ski. A similar arrangement of the other illustrated embodiments in FIGS. 2, 3, 5 and 6 is also provided. In FIG. 1 the ski has a core 8. The core can be formed of wood, plastics material, foamed plastics material, glass fiber-reinforced foamed plastics material or the like. All previously known core construction materials can be used in forming the core. The upper and lower sides of the core are covered by a web 2, 6 which is formed in two parts divided in the width direction of the ski. The web is made up of two halves 2, 6, each with a different shear modulus. The right-hand half 2 of the web has a high shear modulus, for example, on the magnitude of 40–45000 N/mm2, which corresponds to a shearing force of approximately 1500–2000 kN and is formed, for example, of an aluminum alloy. The left-hand half 6 of the web has a lower shear modulus, for example, a magnitude in the range 20–22000 N/mm2 which corresponds to a shearing force of approximately 500–600 kN. The half 6 is formed of an epoxy-fiberglass-laminate. Cover layer 1 can be produced from plastics material or metal. Running base layer 7 is defined laterally by steel edges 3 interconnected by an intermediate web 4 composed of an anuminum alloy or a fiberglass-reinforced plastics material laminate. The lower web 2, 6 is constructed in the same manner and of the same material as the upper web and extends in the longitudinal direction of the ski.

Figure 2:
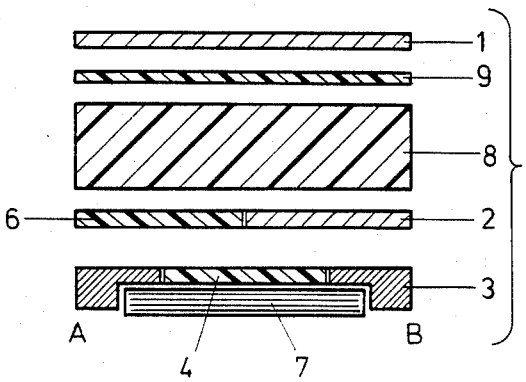

In the embodiment illustrated in FIG. 2, the only difference from the embodiment in FIG. 1 is that the upper web 9 is constructed as a single unit and is formed of an epoxy-fiberglass-laminate. The remaining structural components of the ski correspond to the description concerning FIG. 1 and for this reason the same reference numerals are used. Similarly, the same reference numerals are used in the other embodiments.

It is possible, in principle, to locate the unitary web 9 below the core 8 and to provide a web divided in two halves 2, 6 on the upper side of the core. In the two embodiments illustrated in FIGS. 1 and 2, the halves 2, 6 of the web in contact with the core 8 have the same thickness. In place of the two-part web disclosed in FIGS. 1 and 2, a multipart web can be used, that is a web formed of more than two parts of the same thickness, however, the individual parts have different shear moduli and the arrangement is effected so that the size of the shear moduli increase or decrease across the width of the skis.

Figure 3:
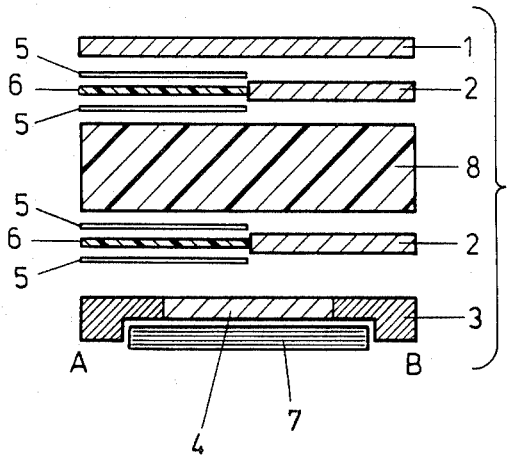

In the embodiment displayed in FIG. 3, the web halves 6 have a smaller thickness that the other web halves 2, that is, the halves 6 are thinner than the halves 2. To provide an equal thickness across the width of the webs 2, 6, compensation layers 5, formed of elastic materials, for example, rubber or polyurethane elastomers, are provided on the opposite sides of the thinner web half 6.

Figure 6:
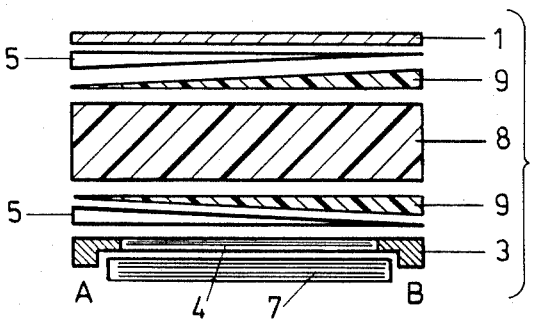

In the embodiments shown in FIGS. 1 and 2, the web halves 2, 6 are constructed of an equal thickness but with different shear moduli. In the embodiment illustrated in FIG. 3, the half or part 6 of the web is provided with the smaller or lesser thickness than the half or part 2. Accordingly, the two web parts have a different thickness. In this arrangement, the two web parts 2, 6 can have the same shear modulus or different shear moduli as mentioned above in more detail in relation to the embodiments set forth in FIGS. 1 and 2. The outwardly determinable effect of this special construction, which can also be achieved with a web having a specific uniform thrust modulus, is constructed in a stepwise manner along its entire width, as shown in FIG. 3. The desired effect is naturally reinforced if web parts 2, 6 of different shear moduli are utilized. The web constructed from the two parts 2, 6 as shown in FIG. 3, is stepped in the central region of the ski. It would also be conceivable to employ a web which has a triangular cross section. Thickness compensation can be effected in such an arrangement by using elastic materials. Such an arrangement is shown in FIG. 6.

In the embodiments disclosed, according to FIGS. 1, 2 and 3, the edge side A has the lower turning resistance and the edge side B has the higher turning resistance.

Figure 4:
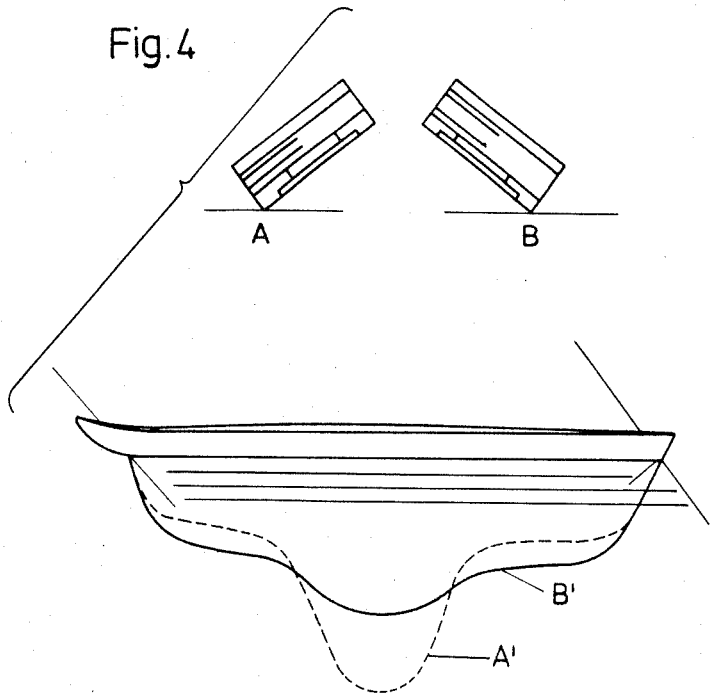
FIG. 4 is a schematic representation of the effect of the different turning resistance on the edge pressure distribution.

FIG. 4 shows the effect of the different turning resistances on the edge pressure distribution. Two skis, forming a pair of skis, are shown in the upper part of FIG. 4 arranged diagonally or inclined relative to the running surface. In the lower part of FIG. 4, lines A′ and B′ designate the corresponding edge pressures along the length of the ski. This figure clarifies the above-mentioned description.

In the embodiments in FIGS. 1, 2, 3 and 6 as shown, individual structural components of the ski have different shear moduli as seen across the width of the ski, that is, the structural components are formed of different kinds of material.

Figure 5:
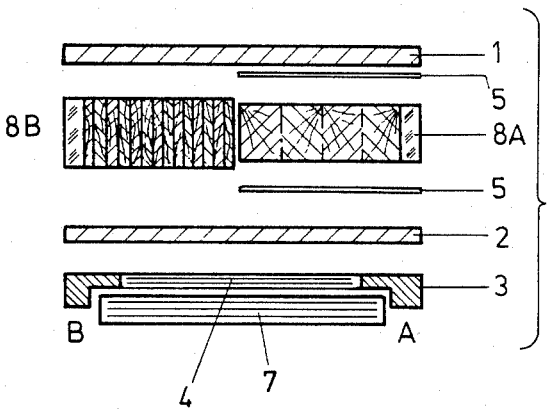

The embodiment illustrated in FIG. 5 shows another possible arrangement of the parts forming the ski. In this embodiment, the core is made of two parts with one half 8B of the core formed of a material with a high shear modulus, for example ash or polyurethane with a considerable thickness, and the other half 8A is composed of a material with a low shear modulus, such as polyurethane with a small thicknes, or okumé The desired effect can be increased in the embodiment in FIG. 5 not only by using different materials for the two core parts 8A, 8B, but also by using different thicknesses. If different thicknesses are used it is advisable to provide elastic compensation layers 5 so that the combined core has the same thickness across its full width.

In the embodiments displayed in FIGS. 1, 2, 3 and 5, the divisional plane separating the webs or core in two extends in the longitudinal central plane of the ski. This division plane, however, can be offset somewhat with respect to the longitudinal central plane of the ski so that the longitudinal ski parts thus formed are not truly halves in a geometric sense. Instead of a single divisional plane, several, for instance, two or three, can be used and in this latter case, when there is a possible extreme relation of the different shearing forces, there can be utilized a central compensation part.

The various embodiments exhibited in the drawings, can, naturally, be varied and combined in order to achieve the desired object in accordance with the present invention.

While specific embodiments of the invention have been shown and described in detail to illustrate the application of the inventive principles, it will be understood that the invention may be embodied otherwise without departing from such principles.

I claim:

1. A multilayer ski having a sandwich type construction and a central longitudinal axis, comprising a core, a cover layer located on one side of said core and a running base layer located on the other side of said core, and at least one web located between said core and one of said cover layer and running base layer, said multilayer ski having a pair of opposite side surfaces extending in the long direction of the ski and between said cover layer and said base layer, said core, said cover layer, said running base layer and said at least one web extending in the long direction of the ski for at least a significant length of the ski and between said opposite side surfaces, wherein the improvement comprises that at least one of said web and said core is divided in the width dimension between said opposite side surfaces into at least a first part and a second part each extending in the length dimension of the ski and each of said first part and second part have a different shear moduli each of said longitudinally extending first and second parts of said ski is located on an opposite side of an imaginary divisional plane extending perpendicularly to said running base from the other one of said first and second parts, the divisional plane extends in the long direction of the ski and is positioned at least adjacent the central longitudinal axis of the multilayer ski so that each of said first and second parts has a different torsional strengths.

2. A multilayer ski, as set forth in claim 1, wherein each of said first and second parts is composed of a different material.

3. A multilayer ski, as set forth in claim 2, wherein said first and second parts are of the same transverse cross-sectional size.

4. A multilayer ski, as set forth in claim 1, wherein said first and second parts each have a different thickness dimension, and compensation layers are associated with the thinner said part for effecting a uniform thickness for said at least one of said web and said core across the width thereof formed by said first and second parts.

5. A multilayer ski, as set forth in claim 4, wherein said compensation layers are formed of an elastic material.

6. A multilayer ski, as set forth in claim 5, wherein said elastic materials are formed of one of the group consisting of rubber and polyurethane elastomer.

7. A multilayer ski, according to claim 1, wherein the relation of the different shearing strengths across the width of said ski is in the range of approximately 1:2 to 1:3, and the shearing strength is made up of the product of the shear modulus and the corresponding cross-sectional surface of the parts of at least one of said web and core formed by said first and second parts.

8. A multilayer ski, as set forth in claim 1, wherein said parts of at least one of said web and core are divided into halves with each half having the same thickness.

9. A multilayer ski, as set forth in claim 1, wherein said first and second parts form said web and and each forms an equal half of the ski width dimension between said opposite side surfaces and one of said halves has a smaller thickness dimension than the other said half.

* * * * *